US008717129B1

(12) United States Patent
Cash

(10) Patent No.: US 8,717,129 B1
(45) Date of Patent: May 6, 2014

(54) LEVITATING FOOTBALL HELMET

(76) Inventor: Phillip Cash, Chatsworth, GA (US)

( * ) Notice: Subject to any disclaimer, the term of this patent is extended or adjusted under 35 U.S.C. 154(b) by 1507 days.

(21) Appl. No.: 11/711,287

(22) Filed: Feb. 27, 2007

(51) Int. Cl.
*H01F 7/02* (2006.01)
*A63H 33/26* (2006.01)

(52) U.S. Cl.
USPC ..... 335/306; 446/129

(58) Field of Classification Search
USPC ..... 446/129
See application file for complete search history.

(56) References Cited

U.S. PATENT DOCUMENTS 2,693,788 A * 11/1954 Spatz ..... 211/69.1
2,702,191 A * 2/1955 Lemelson ..... 273/393
3,139,865 A * 7/1964 Aimes ..... 211/69.5
3,196,566 A * 7/1965 Littlefield ..... 40/411
4,486,729 A * 12/1984 Lee ..... 335/306
4,901,456 A * 2/1990 Cotutsca ..... 40/711
5,182,533 A * 1/1993 Ritts ..... 335/306
5,188,555 A * 2/1993 Zbegner ..... 446/133
5,506,459 A * 4/1996 Ritts ..... 310/90.5
5,589,721 A * 12/1996 Han et al. ..... 310/90.5
5,842,902 A * 12/1998 Liff ..... 446/130
D420,670 S * 2/2000 Hernandez et al. ..... D14/232
6,739,938 B2 * 5/2004 Dokoupil ..... 446/129
6,761,610 B2 * 7/2004 Fisher et al. ..... 446/129
D498,431 S * 11/2004 Ditmars, Jr. ..... D11/131
2003/0176144 A1 * 9/2003 Fisher et al. ..... 446/133

* cited by examiner

*Primary Examiner* — Alexander Talpalatski
(74) *Attorney, Agent, or Firm* — Stephen J. Stark

(57) ABSTRACT

A levitating display article provides a base which supports a display spaced from first and second plates of the base in a levitating manner. The display has a first target at least a second and preferably a third target spaced apart from a levitating axis preferably opposite the article from the first target. The targets are preferably magnets and more preferably high strength magnets but could be conductive materials in other embodiments. In the preferred embodiment, helmets such as football helmets, racecar helmets, batting helmets having a void at the bottom and at least two lower targets spaced relative to the wood are provided connected to the helmet structure.

18 Claims, 3 Drawing Sheets

LEVITATING FOOTBALL HELMET

FIELD OF THE INVENTION

The present invention relates to a levitating display and more specifically to a base configured to levitate an object utilizing at least one of a magnetic and an electrical field and more particularly, a device with a levitating object having spaced apart targets such as magnets separated by a void with a levitating axis extending through the void.

DESCRIPTION OF PRIOR ART

Levitating globes have been done in the prior art. A globe is a completely enclosed round sphere which is normally believed to be made in halves. Before assembly, two targets are placed in an opposing top position and bottom position symmetrically aligned along a levitation axis of the globe. When the sphere is then placed in proper relationship with the levitating base in energized, the globe then "levitates" in a relationship to the base with the two magnets aligned with the levitating axis and the magnetic field supporting the globe spaced from the base.

While this prior art technique works with completely enclosed objects such as a sphere such as a globe or ball, it does not lend itself well to open shell type devices to which an orientation may be desired whereby there may not be a convenient bottom or other portion to locate a bottom target, normally a magnet aligned with the top target and the levitating axis. Accordingly, improvements over the state of the art are believed to be necessary.

SUMMARY OF THE INVENTION

It is an object of the present invention to provide a levitating target preferably supported between first and second plates in a levitating manner by at least one of electric and magnetic fields therebetween. The target is preferably selected from such three-dimensional objects as sports balls, sporting equipment such as but not limited to helmets, bats, jerseys, model cars, etc. The target at least in some embodiments such as the helmet illustrated has a void at a bottom portion of the helmet to which there is no convenient connecting structure to attach a magnet which would be aligned along the desired axis of levitation intermediate opposing plates which is how prior art levitating globes are believed to normally be supported.

Accordingly, instead of using a single bottom magnet, at least two spaced apart targets opposite each other and spaced at least partially about the void are utilized. Three or more could also be utilized and even a donut or other shaped magnet, etc., could be used instead of multiple magnets. Additionally, the target can be made to rotate in at least a preferred embodiment. Furthermore magnetic and nonmagnetic materials may be provided as a portion of the target and display.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
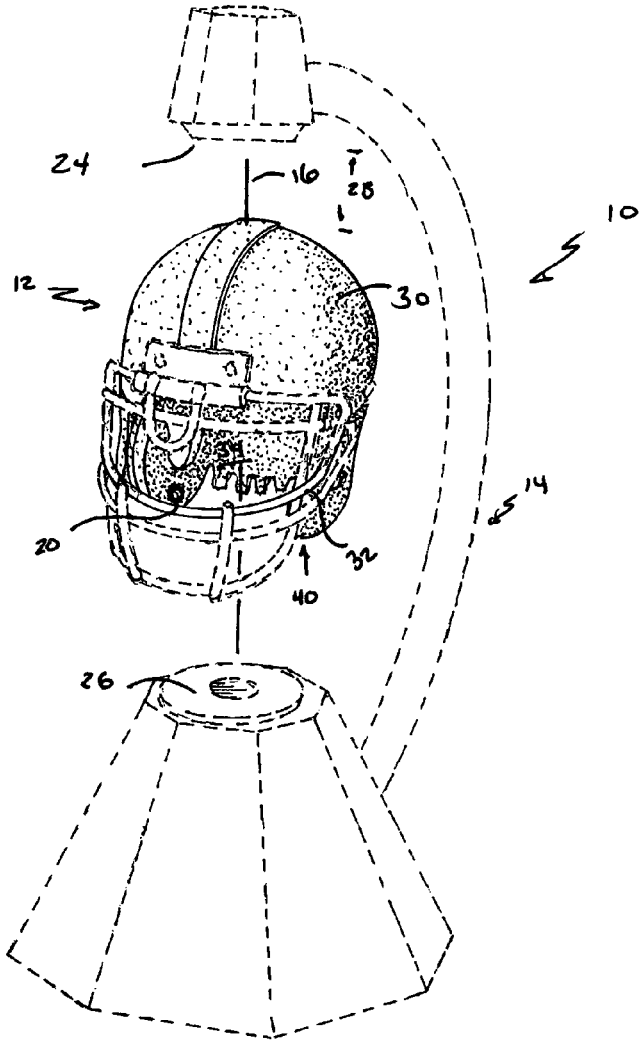
FIG. 1 is a top perspective view of a presently preferred embodiment of the present invention.
Figure 2:
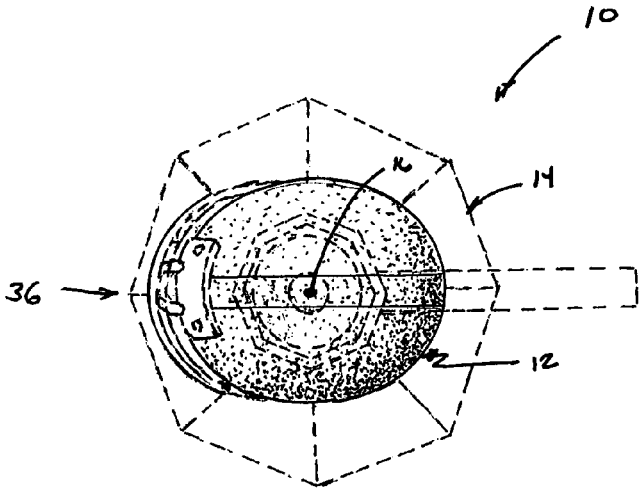
FIG. 2 is a top plan view of the embodiment of FIG. 1.
Figure 3:
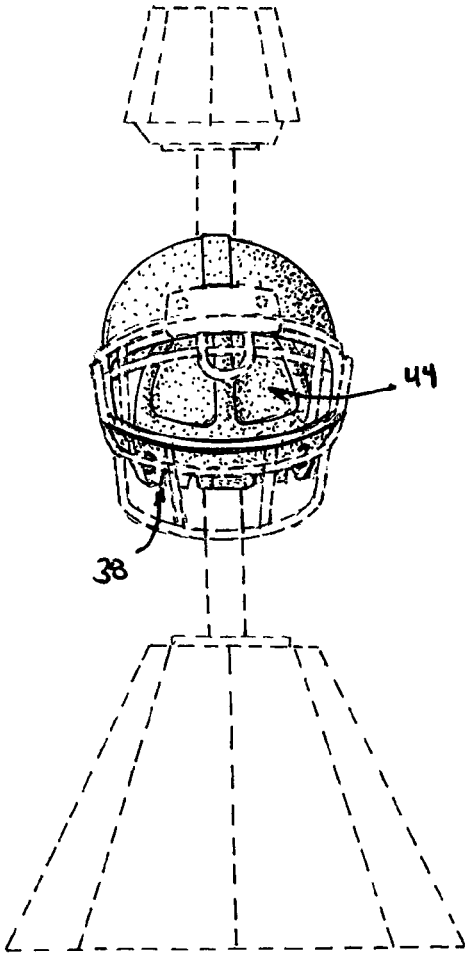
FIG. 3 is a front plan view of the embodiment of FIG. 1.

FIG. 1 is a top perspective view of a suspension system 10 having a levitating display 12 which is illustrated in the presently preferred embodiment as a football helmet but could be any other number of articles which will be discussed in detail below. The suspension system 10 also has a base 14 which is shown principally in phantom as there are a variety of configurations of bases currently available on the market in different configurations. All the bases known by the applicant work on magnetic, electronic and electromagnetic fields to assist in suspending or otherwise levitating display 12 in a desired position.

An improvement over prior art designs provides a levitating display 12 that lacks does not have collinearly aligned top and bottom magnets as has been utilized in the prior art along the levitation axis 16. A first or top target 18 is illustrated as a magnet in the presently preferred embodiment. In other embodiments first target 18 could include a ferrous material or other appropriate material that could be suspended with at least one of magnetic and electronic fields as will be described below. The first target 18 is preferably located along a levitating axis 16. However, instead of having a second or lower target collinearly aligned on this axis as has been done in the prior art, the applicant has at least one, and preferably two spaced apart targets 20,22 which are spaced apart from the levitation axis 16. The targets 20,22 are preferably symmetrically disposed relative to the levitation axis 16. As would be understood by one of ordinary skill in the art, more than two lower targets 20,22 could be utilized in other embodiments such as three or more. A single target 20 or 22 could also be utilized in other embodiments (like a donut shape surrounding a void, etc.)

The targets 18,20,22 of the preferred embodiments are magnets and more preferably high strength magnets which have been found to assist in levitation process when combined with magnetic fields emitted from the base 14 and upper plate 24 and lower plate 26. In fact, a magnetic field sensor is believed to disposed relative to one of the first and second plates 24,26 which measures magnetic value related to a distance of levitation such as a depth 28 of the display 12 relative to at least one of the plates 24,26. This information is believed to be provided to a processor acting in conjunction with the base to adjust at least one of an electric and/or magnetic field emitted relative to at least one of first and second plates 24,26. Although first and second plates 24,26 are referred to as plates, they are not necessarily planar could have virtually any shape as would be known to those of ordinary skill in the art. Other embodiments might have a single plate.

In the prior art, the globes which were levitated relative to bases have collinearly aligned targets along the levitation axis 16. This is not believed to be an attractive option for the use of display items such as helmets which is the illustrated levitating display 12 in that there is no bottom of the helmet 30 to which to attach the bottom magnet thereon to align the helmet 30 in a desired orientation relative to the levitation axis 16 (i.e., it would be difficult to keep it aligned in a position as if it were about to be worn using top and bottom type prior art techniques). Furthermore, there was not believed to be a convenient place to locate the bottom magnet.

When the targets 18,20,22 are magnets, the applicant has discovered that a metal face mask 32 may be also utilized without significantly interfering with the magnetic field. The applicant is unaware of other attempts in the prior art to provide such a structure. The metal face mask weighs at least 2%, 5% and possibly 10% or more of the weight of the display 12.

Accordingly, the display 12 is believed to be the only display available on the market in which metal portions at least 5% of the weight of the display 12 is metal and is an electrical and magnetic conductor and more preferably more than 10% of the weight of the display 12 is the metal conductor when the targets 18,20,22 used are magnets. Additionally, dissimilar materials such as foam padding 34 is also present in conjunction with a plastic helmet 30 but other materials could also be utilized. The applicant is unaware of any combination of materials as a levitating device other than a uniform hollow shell normally of plastic normally in the form of a globe or ball with any dissimilar materials other than the targets.

By employing different materials, a realistic display 12 can be provided which has heretofore not been believed to have been done by others. Other examples could be a race car and design having rubber looking tires of a different material than the body panels of the car, batting helmets having foam insert portions, etc. Furthermore, baseball caps, racing helmets, and a number of other displays 12 may be employed. Furthermore, jerseys such as one having an insert, baseball gloves, bats, hockey sticks, balls, pucks, race cars and any number of articles can be suspended in a levitating manner to utilize the applicant's disclosure. It will be understood that scale of these articles will likely be miniaturized but some full sized articles or supersized articles could also be levitated.

Figure 4:
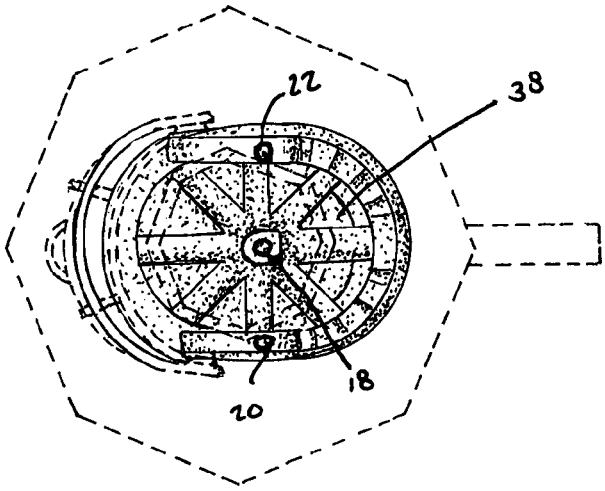
FIG. 4 is a bottom plan view of the embodiments of FIG. 1.

In the preferred embodiment, the helmet 30 is a plastic material having targets 18,20,22 with first target 18 aligned with the levitation and/or rotation axis 16 and the second and third targets 20,22 preferably spaced from an symmetrically disposed relative to the levitation axis 16. A metal face mask covers a portion of a front 36 of the helmet 30 and a void 38 shown in FIG. 4 exists at at least a bottom portion of the helmet 30 leading into a cavity 44 which in for real helmets would allow access for a head to be inserted into the helmet 30. The second and third targets 20,22 are spaced about the cavity 44 and void 38 and are connected to the helmet 30. Additionally, in the preferred embodiment, the second and third targets 20,22 are spaced above a lower portion 40 of display 12 and are connected to portions of the display 12, namely, at least one of the helmet 30 and foam 34 or other portions of the display 12 as might occur in other embodiments. Portions of the cavity 44 and/or void 38 preferably separate the second and third targets 20,22. For instance, if a car were utilized, it is possible that the four wheels may contain four targets (or possibly a front right and a left rear tire may have the targets or other possibilities certainly abound).

Figure 6:
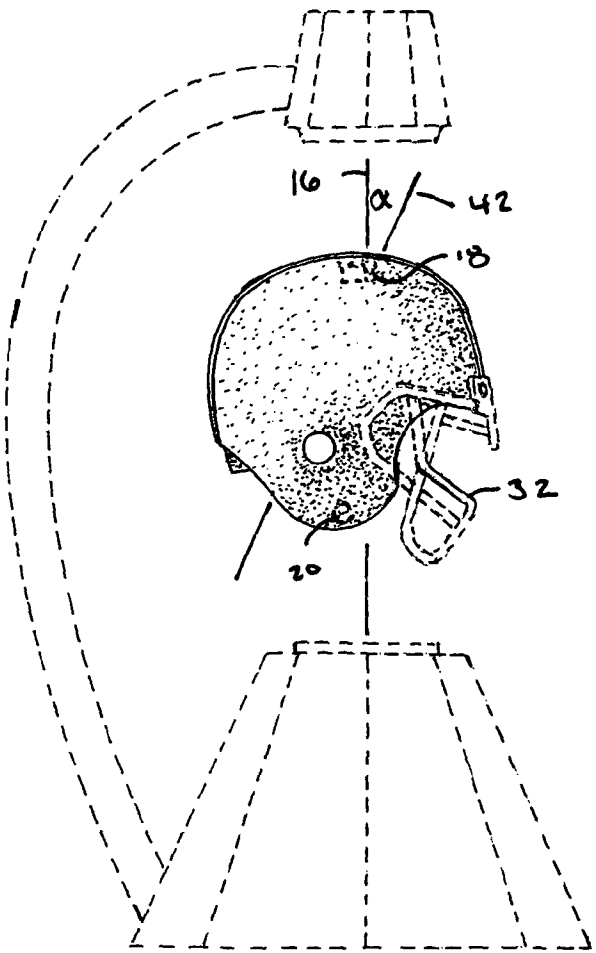
FIG. 6 is a side plan view of the embodiment of FIG. 1.

Although placement of the various targets 18,20,22 may require some trial and error to get a desired tilt such as could be expressed by angle $\alpha$ between levitation axis 16 and normal wear axis 42 shown in FIG. 6 so that the angle $\alpha$ may be minimized or set to a desired orientation based on the relative placements of the first target 18 shown in phantom along with second and third targets 20,22 to provide a desired orientation of display 12. Of course, it may be that the amount of conductive material such as face mask 32 utilized in particular embodiments may effect the appropriate placement of at least one of the first target 18 and/or second and third targets 20,22 or other targets if utilized. If utilizing a preexisting base 14 configurations available on the market which may already be programmed to adjust the electromagnetic field based on particular sensed input from sensors, the placement of targets 18,20,22 may initially be by trial and error to achieve a desired a angle and cant angle $\beta$ as will be described below. In addition to placement of the respective targets 18,20,22 a selection of the particular material for targets 18,20,22 can have a bearing as well depending on the strength of the magnetic field generated by those targets, if any. Angle $\alpha$ may also reflect an angle intermediate an axis of a center of balance (such as a normal wear axis 42) and the levitating axis 16.

As is the case in most displays in the preferred embodiment, material selection and relative distance 28 relative to at least one of the plates 24,26 can be varied based on weight of the display 12 and other factors.

In the preferred embodiment, the helmet 30 is somewhat of a shell in that it has an internal cavity 44 accessible to one or more voids 38 such as a bottom of the helmet. In other embodiments, such a coffee cup the void may be toward a top of the cup leading into a cavity where coffee may be directed. In such an embodiment, a single target may be at the bottom of the cup and more than one targets may towards the top of the cup to levitate the coffee cup. It will be understood by those of ordinary skill in the art that other objects such as baseball gloves, batting helmets, Nascar® racing helmets, baseball caps, and other sporting attire and accessories and even non-sporting displayed items may be levitated in a desired manner which heretofore have been unable to be levitated due to the presence of one or more voids to which in the traditional form a magnet would have otherwise been aligned with the levitating axis 16. In still other embodiments multiple spaced apart first targets such as could be used to levitate a hollow cylinder of other object could also be employed.

Of course, in some embodiments and in even the presently preferred embodiment the levitation axis 16 is also a rotation axis and either the base 14 rotates the display 12 or once the display 12 begins to rotate about the levitation axis 16, it continues to rotate until stopped in some embodiments.

Figure 5:
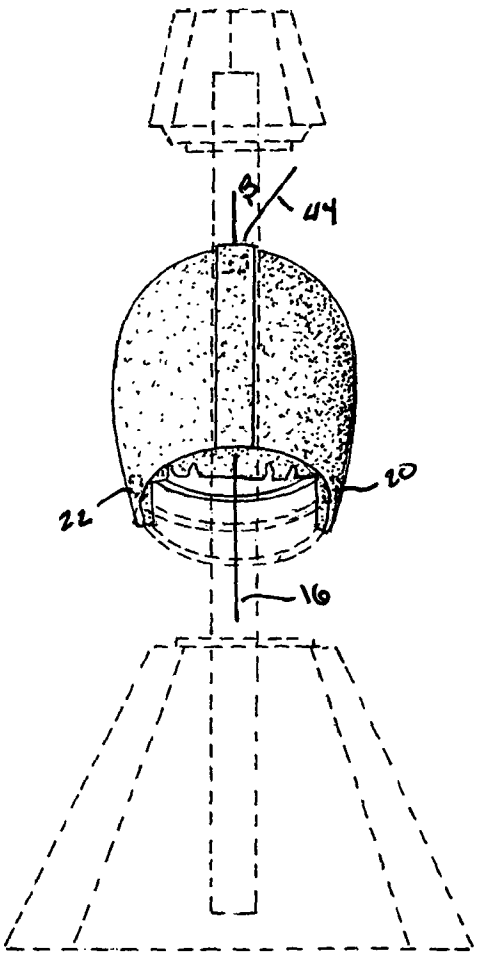
FIG. 5 is a back plan view of the embodiment of FIG. 1.

FIG. 5 shows that the levitation axis 16 is aligned with the normal support axis 42 as it relates to this orientation as is placed in this view which is consistent with FIG. 6. In other embodiments, it may be possible to tilt the display 12 left or right so as to have an angle $\beta$ between the levitation axis and a normal lack of cant axis 44. Although the angle $\beta$ does not exist in FIG. 5 except as represented the preferable cant of the helmet is straight up but it or other displays could be canted to the left or to the right which would be understood by one of ordinary skill in the art which may be advantageous for the display of some products such as a baseball glove about to catch a ball or other display article 12. Additionally, an article such as a football may be made to levitate or rotate about an axis which is not coaligned with the two points of the football.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A suspension system comprising:

a base having a field of at least one of a magnetic and an electric field, said field disposed intermediate first and second plates with the first plate located above the second plate;

a display spaced from the first plate and suspended by the field intermediate the first plate and the second plate with the display located between the first and second plates, said display having a first magnet target connected to the display and at least second and third magnet targets spaced from the first target, and said second magnet target spaced from said third magnet target; wherein a levitating axis is defined extending through the first plate, second plate and first target, and the second and third targets are non-colinear with the levitating axis; and wherein said first, second and third targets cooperate with the field to levitate the display relative to the base to be free from physical contact with the base.

2. The suspension system of claim 1 wherein the first target is connected to an upper portion of the display and the second and third magnet targets are located below the first magnet target.

3. The suspension system of claim 1 wherein the display rotates with the field, and said field is rotated with adjustments relative to the base.

4. The suspension system of claim 1 wherein the display has a shell having a cavity therein.

5. The suspension system of claim 4 further comprising a void at one of an upper and a lower portion of the shell leading into the cavity, and the second and third magnet targets have at least a portion of the cavity between the second and third magnet targets.

6. The suspension system of claim 1 wherein the second and third targets are symmetrically disposed relative to the levitating axis.

7. The suspension system of claim 5 wherein the second and third targets are connected to the shell and extend at least partially above the void.

8. The suspension system of claim 1 wherein the axis of levitation is not collinear with a center of balance axis.

9. The suspension system of claim 1 wherein the display is selected from one of a group of a football helmet, a baseball batting helmet, a baseball cap, and a race car helmet.

10. A suspension system comprising:

a base having first and second plates and a field of at least one of a magnetic and an electric field disposed intermediate the first plate which is located above the second plate;

a display spaced from the plates and suspended by the field intermediate the first and second plates, said display having a cavity, a first magnet target connected to the display, and at least second and third magnet targets spaced from the first magnet target connected to the display, and said second magnet target spaced from said third magnet target; with at least a portion of the cavity intermediate the second and third magnet targets; wherein the first, second and third magnet targets cooperate with the field thereby supporting the display relative to the base and wherein the display does not physically contact the base and is located above the second plate and below the first plate.

11. The suspension system of claim 10 further comprising a shell at least partially surrounding the cavity with a void leading into the cavity from outside of the display.

12. The suspension system of claim 10 wherein a levitating axis is defined extending through the first and second plates as well as through the first target.

13. The suspension system of claim 10 wherein the display is selected from one of the group of a football helmet, a baseball batting helmet, a baseball cap, and a race car helmet.

14. A suspension system comprising:

a base having a field of at least one of a magnetic and an electric field, said field disposed at least partially intermediate first and second plates, said first plate located above the second plate;

a display spaced from the plates and suspended by the field intermediate the first and second plates, said display having a shell with a void entering into a cavity within the shell, and a first magnet target connected to the display and at least a second magnet target spaced from the first target wherein;

a levitating axis is defined extending through the first and second plates, and the second magnet target is non-colinear and spaced relative to the levitating axis and the first and second magnet targets cooperate with the field to levitate the display with the levitating axis passing through the display so that the display does not contact the base and is located below the first plate.

15. The suspension system of claim 14 wherein the display is selected from one of the group of a football helmet, a baseball batting helmet, a baseball cap, and a race car helmet.

16. The suspension system of claim 14 further comprising a third magnet target spaced from the second target which further assists in levitating the display relative to the base.

17. The suspension system of claim 16 wherein the first magnet target is located along the levitating axis.

18. The suspension system of claim 14 wherein the levitating axis extends through the void.

* * * * *